US007225482B2

(12) United States Patent
Brooks

(10) Patent No.: US 7,225,482 B2
(45) Date of Patent: Jun. 5, 2007

(54) HOIST

(75) Inventor: Les Brooks, West Derby (GB)

(73) Assignee: Huntleigh Technology, PLC (GB)

( * ) Notice: Subject to any disclaimer, the term of this patent is extended or adjusted under 35 U.S.C. 154(b) by 594 days.

(21) Appl. No.: 10/779,174

(22) Filed: Feb. 13, 2004

(65) Prior Publication Data

US 2004/0232395 A1 Nov. 25, 2004

(30) Foreign Application Priority Data

Feb. 24, 2003 (GB) ..... 0304176.1

(51) Int. Cl.
*A61G 7/10* (2006.01)

(52) U.S. Cl. ..... 5/83.1; 5/87.1

(58) Field of Classification Search ..... 5/81.1 R, 5/83.1, 86.1, 87.1; 254/123, 124, 126, 129, 254/130, 8 R, 8 B, 9 R, 10 R; 212/342, 212/901, 261

See application file for complete search history.

(56) References Cited

U.S. PATENT DOCUMENTS

| | | | | | |
|---|---|---|---|---|---|
| 2,675,209 | A | * | 4/1954 | Freed | 254/2 R |
| 3,059,785 | A | * | 10/1962 | Buckeye | 414/728 |
| 3,203,009 | A | * | 8/1965 | Lundberg | 5/87.1 |
| 3,222,029 | A | * | 12/1965 | Hildemann | 254/8 R |
| 5,082,127 | A | * | 1/1992 | Huang | 212/299 |
| 5,412,820 | A | | 5/1995 | Richards | |
| 6,164,625 | A | * | 12/2000 | Shockley et al. | 254/8 B |

FOREIGN PATENT DOCUMENTS

| | | | | |
|---|---|---|---|---|
| AU | 66560 81 | A | | 10/1981 |
| EP | 0 574 146 | A1 | | 12/1993 |
| EP | 0 860 395 | B1 | | 8/1998 |
| EP | 0 865 783 | B1 | | 9/1998 |
| FR | 1 407 992 | A | | 8/1965 |
| FR | 2 727 658 | A | | 7/1996 |
| GB | 978 765 | A | | 12/1964 |
| GB | 2105679 | A | * | 3/1983 |

* cited by examiner

*Primary Examiner*—Michael Trettel
(74) *Attorney, Agent, or Firm*—Craig A. Fieschko, Esq.; DeWitt Ross & Stevens S.C.

(57) ABSTRACT

A hoist pivotally connecting mast 1 to lifting arm 2, by a mechanism comprising a link 5 pivoting about a fixed pivot 8 on the mast 1 and a moving pivot 6 on the lifting arm 2. A restraining link 9 between a pivot 10 on the mast 1 and actuator attachment point 11 on the lifting arm 2 restricts the movement of link 5. The second link 9 acts as a stabilizer allowing the pivot 11 on the lifting arm 2 to move only through a set arc, determined by the length of the link 9 and the position of the pivot 10 on the mast 1. With the moving pivot according to the invention, the spreader bar attachment point 7 has a greater traveling distance than if it were simply pivoted about pivot 8 as with conventional hoists.

20 Claims, 3 Drawing Sheets

HOIST

This application claims priority to United Kingdom patent application No. 0304176.1, filed Feb. 24, 2003.

BACKGROUND OF THE INVENTION

The invention relates to a hoist.

It is known to have hoists comprising a mobile chassis, a mast upstanding from the chassis pivotably supporting a lifting arm at its upper end, the lifting arm having a sling attachment at its opposite end. An actuator between the mast and the lifting arm moves the lifting arm about its pivot point with the mast through a given arc. FIG. 1 shows such a prior art hoist with an actuator 12 connected to a mast 1 of the hoist and driving a lifting arm 2 by means of pivot 4, the lifting arm 2 rotated about an arc around pivot 3 on the upper part of the mast 1 of the hoist. However, with such known hoists the lifting arm moves through a limited range of movement between the high and low positions and further requires a large actuator for its operation.

SUMMARY OF THE INVENTION

The present invention seeks to make improvements. Accordingly, the present invention provides a hoist comprising of a chassis, a mast upstanding from the chassis, the mast pivotally supporting a lifting arm at one end wherein the position of the pivot varies with movement of the lifting arm. Among other advantages, the provision of a moving pivot between the mast and the lifting arm results in a larger lifting range for a given lifting arm driven by an actuator of given length. The moving pivot may comprise a link pivotally connected to the mast about a fixed point and pivotally connected to the lifting arm about a moving pivot point. A stabilizing link attached to the mast and actuator may restrict the movement of the moving pivot link.

By the provision of a moving pivot, the invention increases the travel of the lift normally achieved by the same actuator in a fixed pivot hoist. Thus a smaller, discreet and economic actuator can achieve a greater lifting range and reach.

BRIEF DESCRIPTION OF THE DRAWINGS

An embodiment of the present invention is described below, by way of example only, with reference to the accompanying drawings in which:

In the embodiment shown in FIGS. 2 and 3, the invention consists of a hoist having a mechanism pivotally connecting mast 1 to lifting arm 2. The mechanism comprises a link 5 pivoting about a fixed pivot 8 on the mast 1 and about a moving pivot 6 on the lifting arm 2. One or more restraining links 9 between a pivot 10 on the mast 1 and actuator attachment point 11 on the lifting arm 2 restrict the movement of link 5 and a stabilizer allowing the pivot 11 on the lifting arm 2 to move only through a set arc, determined by the length of the link 9 and the position of the pivot 10 on the mast 1. As shown in FIG. 2, when the lifting arm 2 is at its lowest position link 5 is at it its furthest point clockwise restricted by the compression of acuator 12. As the actuator

12 pushes up the lifting arm 2, link 5 rotates anticlockwise about pivot 8. As shown in FIG. 3, as the lift progresses, link 5 continues to move through its arc until the limit of the actuator stroke is reached. Therefore with the moving pivot according to the invention, the spreader bar attachment point 7 has a greater traveling distance than if it were simply pivoted about pivot 8 as with conventional hoists.

Figure 1:
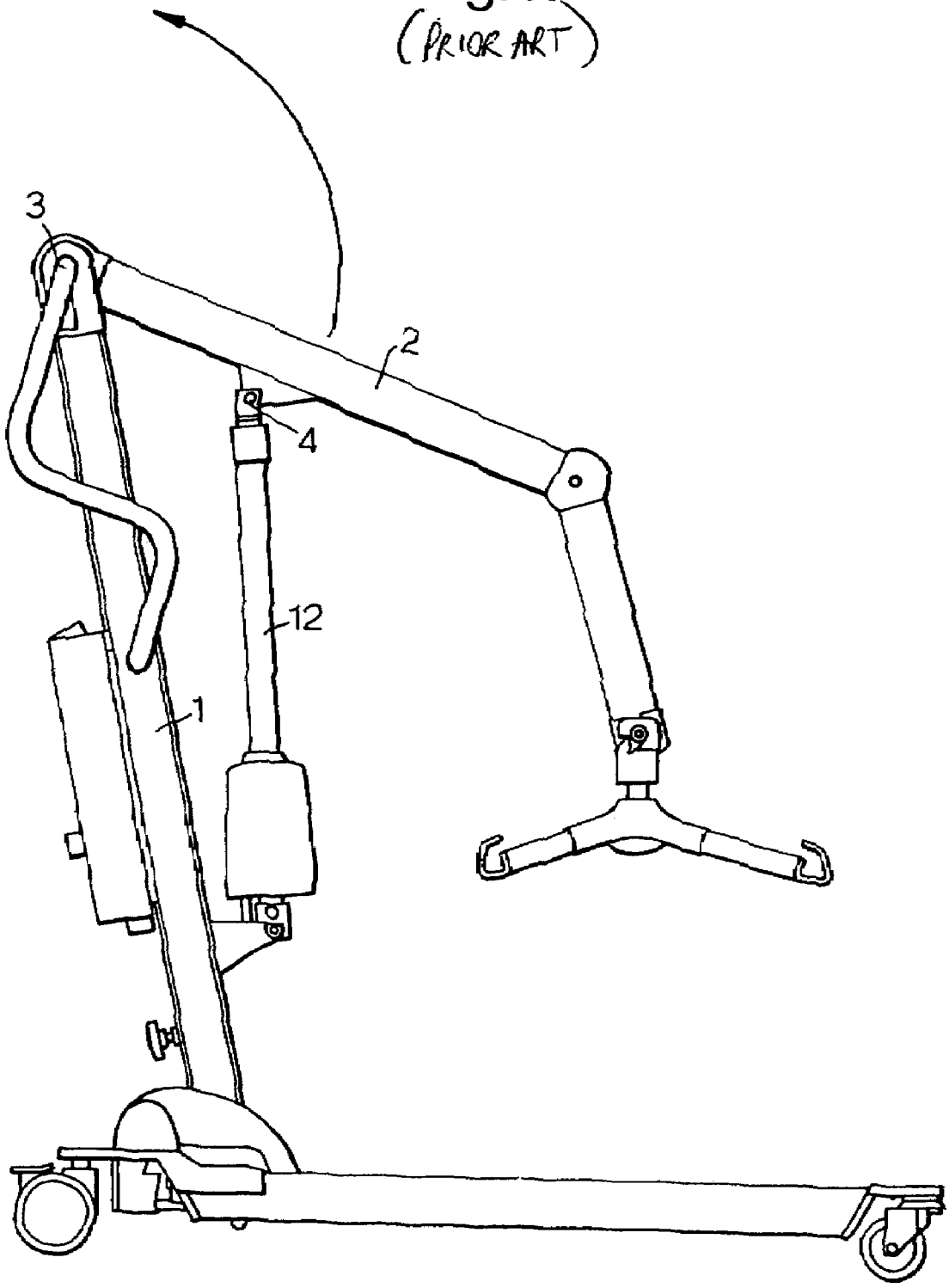
Fig. 1. (PRIOR ART)
FIG. 1 is a schematic view of a hoist with the prior art fixed pivot system.
Figure 2:
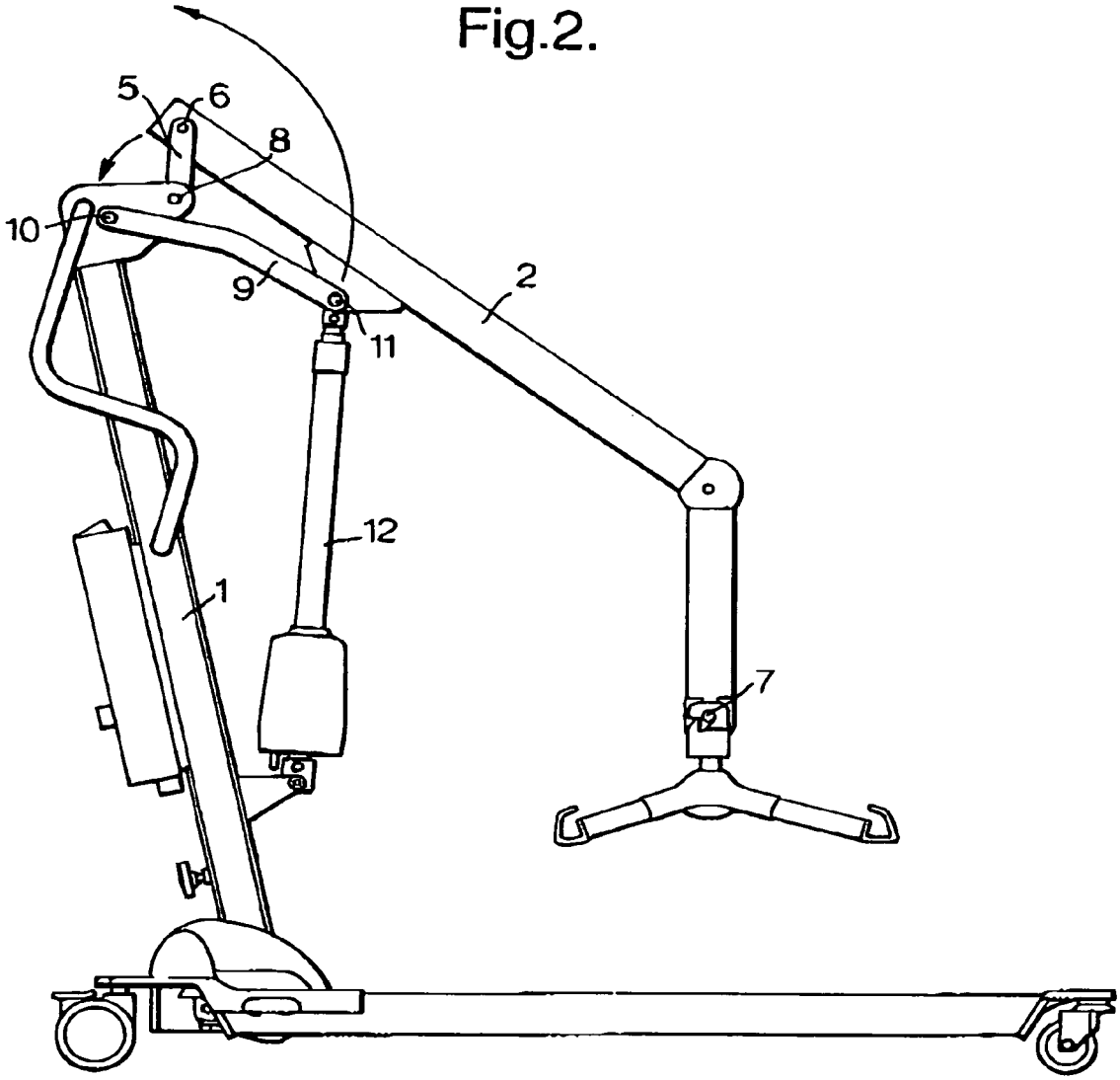
FIG. 2 is a schematic view of a hoist according to the invention in the lowered position.
Figure 3:
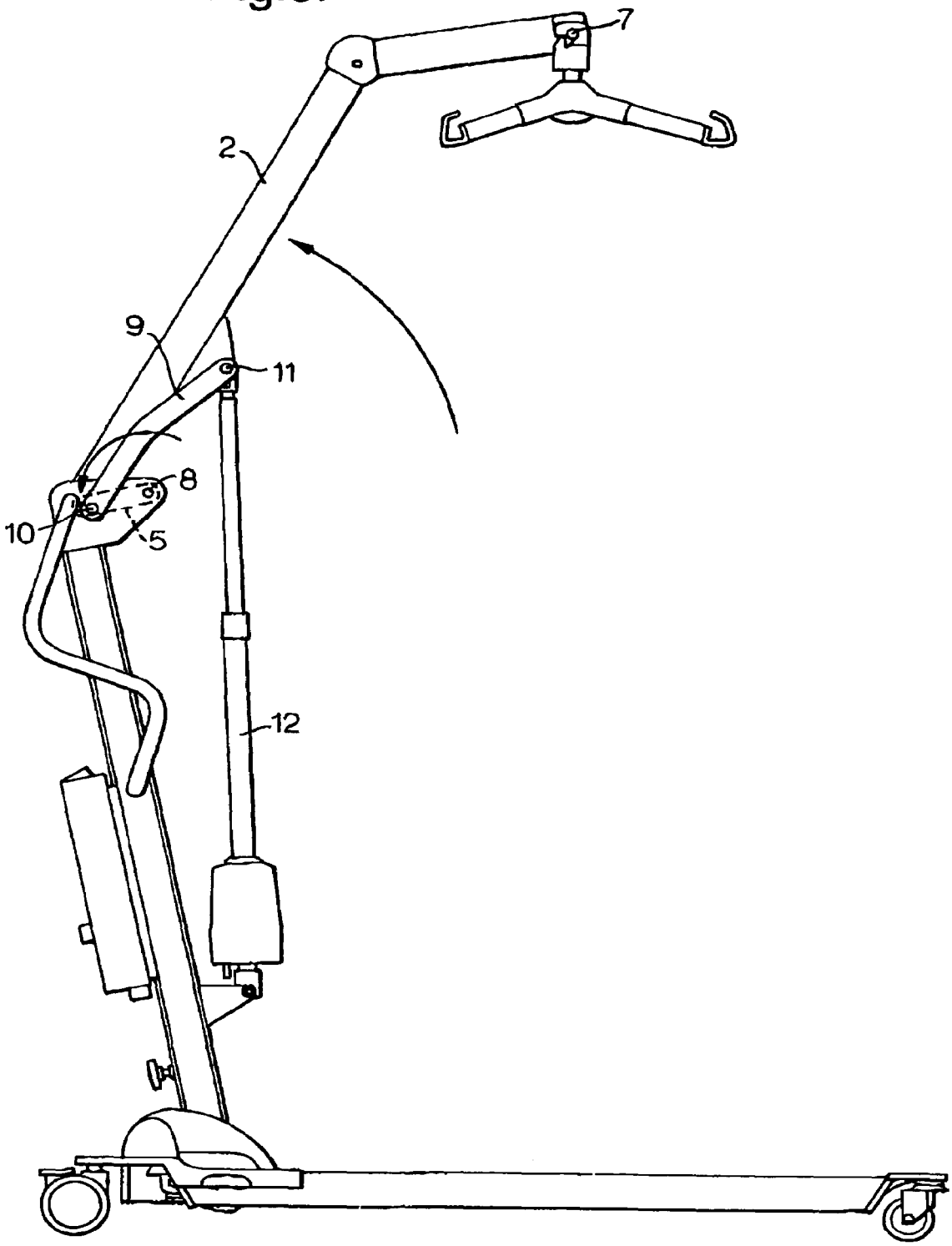
FIG. 3 is a schematic view of a hoist according to the invention in the raised position.

In the embodiment shown, the moving pivot moves accurately from the position of pivot 6 shown in FIG. 2 to a position of pivot 10 as shown in FIGS. 2 and 3, providing a greater range of height and lift using the same actuator.

The invention claimed is:

1. A hoist comprising a chassis, a mast upstanding from the chassis, a lifting arm, and an actuator moving the lifting arm with respect to the mast, wherein:

(1) the mast has a moving pivot pivotally supporting the lifting arm at one end wherein the position of the moving pivot varies with movement of the lifting arm, (2) the moving pivot comprises an intermediate link pivotally connected to the mast about a fixed point and pivotally connected to the lifting arm about a moving pivot point, and (3) a stabilizing link attached to the mast and actuator restricts the movement of the moving pivot.

2. The hoist of claim 1 wherein the fixed point about which the intermediate link pivots is spaced from the longitudinal axis of the mast.

3. The hoist of claim 2 wherein the stabilizing link is pivotally connected to the mast at a point located closer to the longitudinal axis of the mast than the fixed point at which the intermediate link is pivotally connected to the mast.

4. The hoist of claim 1 wherein the stabilizing link is pivotally attached between the mast and actuator.

5. The hoist of claim 4 wherein the stabilizing link has opposing ends, one end being pivotally affixed to the mast and the other end being pivotally affixed to the actuator.

6. The hoist of claim 5 wherein the end of the stabilizing link pivotally affixed to the actuator is also pivotally affixed to the lifting arm.

7. The hoist of claim 1 wherein a four-link loop is defined by:

a. the mast, the mast bearing spaced pivot points affixed to the stabilizing link and to the intermediate link;

b. the intermediate link, the intermediate link bearing spaced pivot points affixed to the mast and to the lifting arm;

c. the lifting arm, the lifting arm bearing spaced pivot points affixed to the intermediate link and the stabilizing link;

d. the stabilizing link, the stabilizing link bearing spaced pivot points affixed to the lifting arm and to the mast.

8. The hoist of claim 7 wherein the distance between the spaced pivot points on the intermediate link is less than the distance between the spaced pivot points on both:

a. the lifting arm, and b. the stabilizing link.

9. The hoist of claim 8 wherein the distance between the spaced pivot points on the mast is less than the distance between the spaced pivot points on both:

a. the lifting arm, and b. the stabilizing link.

10. The hoist of claim 1 wherein the distance between the spaced pivot points on the mast is at least substantially equal to the distance between the spaced pivot points on the intermediate link.

11. A hoist comprising:

a. a mast;

b. a lifting arm;

c. an intermediate link pivotally connecting the mast and the lifting arm;

d. an actuator for moving the lifting arm relative to the mast; and e. a stabilizing link attached to the mast and the actuator, the stabilizing link restricting movement of the link pivotally connecting the mast and the lifting arm.

12. The hoist of claim 11 wherein the intermediate link is pivotally connected to the mast at a point spaced from the longitudinal axis of the mast.

13. The hoist of claim 12 wherein the stabilizing link is pivotally connected to the mast at a point located closer to the longitudinal axis of the mast than the point at which the intermediate link is pivotally connected to the mast.

14. The hoist of claim 11 wherein the stabilizing link is pivotally attached between the mast and actuator.

15. The hoist of claim 14 wherein the stabilizing link has opposing ends, one end being pivotally attached to the mast and the other end being pivotally attached to the actuator.

16. The hoist of claim 15 wherein the end of the stabilizing link pivotally affixed to the actuator is also pivotally affixed to the lifting arm.

17. The hoist of claim 11 wherein a four-link loop is defined by:

a. the mast, the mast bearing spaced pivot points affixed to the stabilizing link and to the intermediate link;

b. the intermediate link, the intermediate link bearing spaced pivot points affixed to the mast and to the lifting arm;

c. the lifting arm, the lifting arm bearing spaced pivot points affixed to the intermediate link and the stabilizing link;

d. the stabilizing link, the stabilizing link bearing spaced pivot points affixed to the lifting arm and to the mast.

18. The hoist of claim 17 wherein the distance between the spaced pivot points on the intermediate link is less than the distance between the spaced pivot points on both:

a. the lifting arm, and b. the stabilizing link.

19. The hoist of claim 18 wherein the distance between the spaced pivot points on the mast is less than the distance between the spaced pivot points on both:

a. the lifting arm, and b. the stabilizing link.

20. The hoist of claim 19 wherein the distance between the spaced pivot points on the mast is at least substantially equal to the distance between the spaced pivot points on the intermediate link.

* * * * *